US007980880B2

(12) United States Patent
Kodama et al.

(10) Patent No.: US 7,980,880 B2
(45) Date of Patent: Jul. 19, 2011

(54) CONNECTOR

(75) Inventors: Shinji Kodama, Makinohara (JP); Hiromasa Kubota, Fujieda (JP)

(73) Assignee: Yazaki Corporation, Tokyo (JP)

( * ) Notice: Subject to any disclaimer, the term of this patent is extended or adjusted under 35 U.S.C. 154(b) by 74 days.

(21) Appl. No.: 12/606,549

(22) Filed: Oct. 27, 2009

(65) Prior Publication Data

US 2010/0111597 A1 May 6, 2010

(30) Foreign Application Priority Data

Nov. 4, 2008 (JP) ..... 2008-282921

(51) Int. Cl.
*H01R 13/627* (2006.01)

(52) U.S. Cl. ..... 439/352

(58) Field of Classification Search ..... 439/352, 439/489, 353, 354, 357–358
See application file for complete search history.

(56) References Cited

U.S. PATENT DOCUMENTS 7,252,530 B2 * 8/2007 Shamoto ..... 439/352
7,591,668 B2 * 9/2009 Nakamura ..... 439/489
2002/0132510 A1 * 9/2002 Tsuji et al. ..... 439/352
2003/0143885 A1 * 7/2003 Nishide et al. ..... 439/352
2004/0014351 A1 * 1/2004 Endo et al. ..... 439/352
2004/0023547 A1 * 2/2004 Oka ..... 439/352

FOREIGN PATENT DOCUMENTS

JP 2004-047168 A 2/2004

* cited by examiner

*Primary Examiner* — Jean F Duverne
(74) *Attorney, Agent, or Firm* — Sughrue Mion, PLLC

(57) ABSTRACT

The present invention prevents two connector housings of a connector from being in a half-fitted condition by increasing restoring force which separates the two housing. A connector includes: a first connector housing including a lock projection; a second connector housing to be fitted to the first connector housing and integrally including a lock arm which is elastically deformed by the lock projection and is engaged with the lock projection; a lock ensuring member including a body which is attached to the second connector housing and movable between an allowing position and a preventing position, and an interference arm which is integrally provided on the body and includes a pressing projection. The pressing projection presses the lock arm while the lock projection deforms the lock arm at the allowing position, and the interference arm abuts the lock arm so as to prohibit the lock arm from deforming in the preventing position.

5 Claims, 8 Drawing Sheets

CONNECTOR

CROSS-REFERENCE TO RELATED APPLICATIONS

This application claims priority from Japanese Patent Application No. JP-2008-282921 filed on Nov. 4, 2008, the entire subject matter of which is incorporated herein by reference.

TECHNICAL FIELD

This invention relates to a connector used for connecting wires. Especially, the connector is equipped with a lock ensuring mechanism.

BRIEF DESCRIPTION OF THE RELATED ART

A wire harness used in a vehicle serving as a mobile body has connectors. There have been proposed such connectors having various lock ensuring mechanisms for confirming whether or not the connector has been completely fitted to a mating connector. As the connectors having such a lock ensuring mechanism, there are a related connector disclosed in JP-A-2004-47168 and a related connector shown in FIG. 8.

The connector 101 shown in FIG. 8 includes a connector housing 104, a lock arm 105, and a lock ensuring member 107. The connector housing 104 receives metal terminals 106 therein. The lock arm 105 is formed integrally on the connector housing 104. When the connector 101 is fitted to a mating connector 110, the lock arm 105 is once elastically deformed, and then is restored into its neutral condition (non-elastically-deformed condition) to be engaged with an engagement portion 126 of the mating connector 110.

The lock ensuring member 107 includes a body 170 movably mounted on the connector housing 104, and an elastic arm 171 formed integrally on the body 170. The lock ensuring member 107 is mounted on the connector housing 104 so as to move between an allowing position (FIG. 8) where the lock ensuring member 107 allows elastic deformation of the lock arm 105 and a preventing position where the lock ensuring member 107 prevents the elastic deformation of the lock arm 105.

When the lock arm 105 is disposed in the neutral condition before it is engaged with the engagement portion 126 and when the lock arm 105 is elastically deformed just before it is completely engaged with the engagement portion 126, the elastic arm 171 of the lock ensuring member 107 interferes with one end portion 105*a* of the lock arm 105, thereby preventing the lock ensuring member 107 from being moved from the allowing position to the preventing position. When the lock arm 105 is restored into the neutral condition after it is completely engaged with the engagement portion 126, the interference of the lock ensuring member 107 with the one end portion 105*a* of the lock arm 105 is canceled by the engagement portion 126, so that the lock ensuring member 107 is allowed to move from the allowing position to the preventing position.

The connector 101 is fitted to the mating connector 110 while the lock ensuring member 107 is located in the allowing position. After the connector 101 is fitted to the mating connector 110, it is checked whether or not the lock ensuring member 107 can be moved from the allowing position to the preventing position, and by doing so, it can be confirmed whether or not the connector 101 has been completely fitted to the mating connector 110.

The connector 101 is a so-called waterproof connector, and a tubular packing 108 is mounted on an outer peripheral surface of the connector housing 104 at a longitudinally-central portion thereof. When the connector 101 and the mating connector 110 are moved toward each other, a distal end of the mating connector 110 elastically deforms the packing 108 to compress the same, and also the engagement portion 126 elastically deforms the lock arm 105 upwardly, and the two connectors 101 and 110 are brought into a half-fitted condition (half-engaged condition) as shown in FIG. 8 (In FIG. 8, for convenience' sake, the packing 108 is shown as having its original shape (that is, as not being elastically deformed), and the lock arm 105 is shown as disposed in the neutral condition). At this time, metal terminals 103 of the mating connector 110 are partially inserted in the respective metal terminals 106, and are electrically connected to the respective metal terminals 106.

When the fitting operation is interrupted in this half-fitted condition, an elastic restoring force of the packing 108 and an elastic restoring force of the lock arm 105 jointly generates a force for moving (or separating) the two connectors 101 and 110 away from each other. The two connectors 101 and 110 are moved away from each other by this separating force, and the metal terminals 103 of the mating connector 110 are withdrawn from the respective metal terminals 106, so that the electrical connection between each mating pair of metal terminals 103 and 106 is interrupted. Thus, the half-fitting of the connectors 101 and 110 can be prevented by the elastic restoring force of the packing 108 and the elastic restoring force of the lock arm 105.

The above connector 101 includes the packing 108, and the half-fitted connectors 101 and 110 are moved away from each other by both the elastic restoring force of the packing 108 and the elastic restoring force of the lock arm 105. However, in the case where the connector 101 is not a waterproof connector, there is no need to provide the packing 108, and therefore the separating force for moving the two connectors 101 and 110 away from each other depends only on the elastic restoring force of the lock arm 105, and the separating force is decreased. Therefore, the half-fitted connectors 101 and 110 could not be moved away from each other, and it was feared that the half-fitting of the connectors 101 and 110 might not been prevented.

SUMMARY

It is an object of this invention to solve the above problem, and more specifically to provide a connector in which a force for moving half-fitted connectors away from each other is increased, thereby preventing the half-fitting of the connectors.

A first aspect of the present invention is a connector including a first connector housing including a lock projection; a second connector housing to be fitted to the first connector housing and integrally including a lock arm which is elastically deformed by the lock projection and is engaged with the lock projection; a lock ensuring member including a body which is attached to the second connector housing and movable between an allowing position and a preventing position, and an interference arm which is integrally provided on the body and includes a pressing projection. The pressing projection presses the lock arm while the lock projection deforms the lock arm at the allowing position, and the interference arm abuts the lock arm so as to prohibit the lock arm from deforming in the preventing position.

A second aspect of the invention is the connector according to the first aspect in which the interference arm has a free end, the pressing projection is provided on the free end, and the pressing projection presses an end of the lock arm. Preferably, the pressing projection superposes the end of the lock arm in a direction in which the lock arm deforms at the allowing position.

A third aspect of the invention is the connector according to the second aspect in which the interference arm includes a interference projection which interferes with the lock arm in a direction in which the body is movable until the lock projection is engaged with the lock arm so as to prevent the body from moving and not interferes the lock arm after the lock projection is engaged with the lock arm so as to make the body movable.

According to the first aspect of the invention, in the half-fitted condition before the lock projection and the lock arm are completely engaged with each other, the pressing projection presses the elastically-deformed lock arm, so that the interference arm is elastically deformed. Because of an elastic restoring force of the elastic arm, the pressing projection presses the lock arm so as to restore the lock arm into a neutral condition. In addition to the elastic restoring force of the lock arm, the pressing force of the lock projection acts on the lock arm, and therefore the force for restoring the lock arm into the neutral condition is increased, and the force for separating the connectors from each other is increased. The connectors disposed in the half-fitted condition can be easily separated from each other, and the half-fitting of the connectors can be prevented.

According to the second aspect of the invention, the pressing projection is formed at a free end of the interference arm, and therefore because of the elastic restoring force of the elastic arm, the pressing projection can positively press the one end portion of the lock arm with a larger force.

According to the third aspect of the invention, the interference projection of the interference arm prevents the movement of the lock ensuring member and also allows this movement. Therefore, the interference projection can be formed on the elastic arm in a simple manner, and the structure of the lock ensuring member can be simplified.

DETAILED DESCRIPTION OF EXEMPLARY EMBODIMENT OF THE PRESENT INVENTION

One exemplary embodiment of a lock ensuring mechanism-equipped connector of the present invention will be described with reference to FIGS. 1 to 7. The connector 1 shown in FIGS. 1 and 2 and others is fitted to a mating connector 10 shown in FIGS. 1 and 2 and others.

Figure 2:
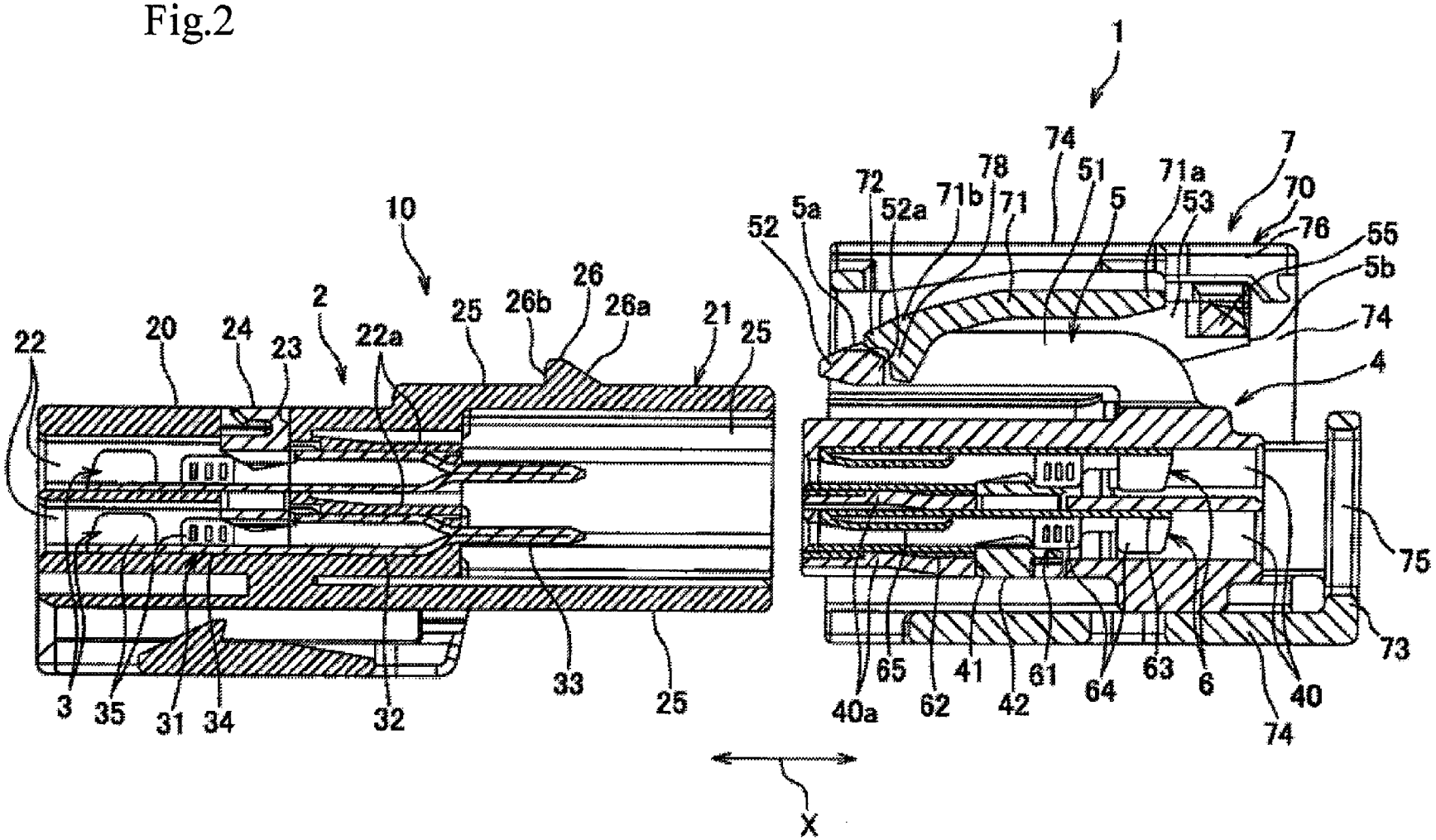
FIG. 2 is a cross-sectional view of the connectors of FIG. 1 taken through a plane different from that of FIG. 1, showing a condition in which the two connectors are opposed to each other.

As shown in FIG. 2 and others, the mating connector 10 comprises a female-type connector housing (hereinafter referred to as "female housing") 2, and male-type metal terminals (hereinafter referred to as "male terminals) 3.

The female housing 2 is made of an insulative synthetic resin or the like, and as shown in FIG. 2 and others, the female housing 2 includes a housing body 20 for receiving the plurality of male terminals 3, and a hood portion 21 for receiving a male housing 4 (described later), the hood portion 21 being formed integrally with the housing body 20. In the present specification, the connector housing which is formed into a tubular shape and into which the male housing 4 is inserted is called "the female housing 2".

The housing body 20 is formed into a generally box-shape, and includes terminal receiving chambers 22, and a spacer receiving chamber 23. The plurality of terminal receiving chambers 22 are arranged in parallel juxtaposed relation. Each terminal receiving chamber 22 extends straight, and longitudinally-opposite ends of the terminal receiving chamber 22 are open respectively to outer surfaces of the housing body 20. The terminal receiving chambers 22 receive the male terminals 3, respectively. A retaining arm 22*a* for retaining the male terminal 3 is formed on an inner surface of each terminal receiving chamber 22.

The mating connector 10 is fitted to the connector 1 along the longitudinal direction of the terminal receiving chambers 22. A direction in which the connector 1 and the mating connector 10 and 1 are moved toward and away from each other in the fitting operation is indicated by arrow X, and this direction will hereinafter be referred to as "the direction X of fitting of the connectors 1 and 10 (or merely as "the fitting direction X").

Figure 1:
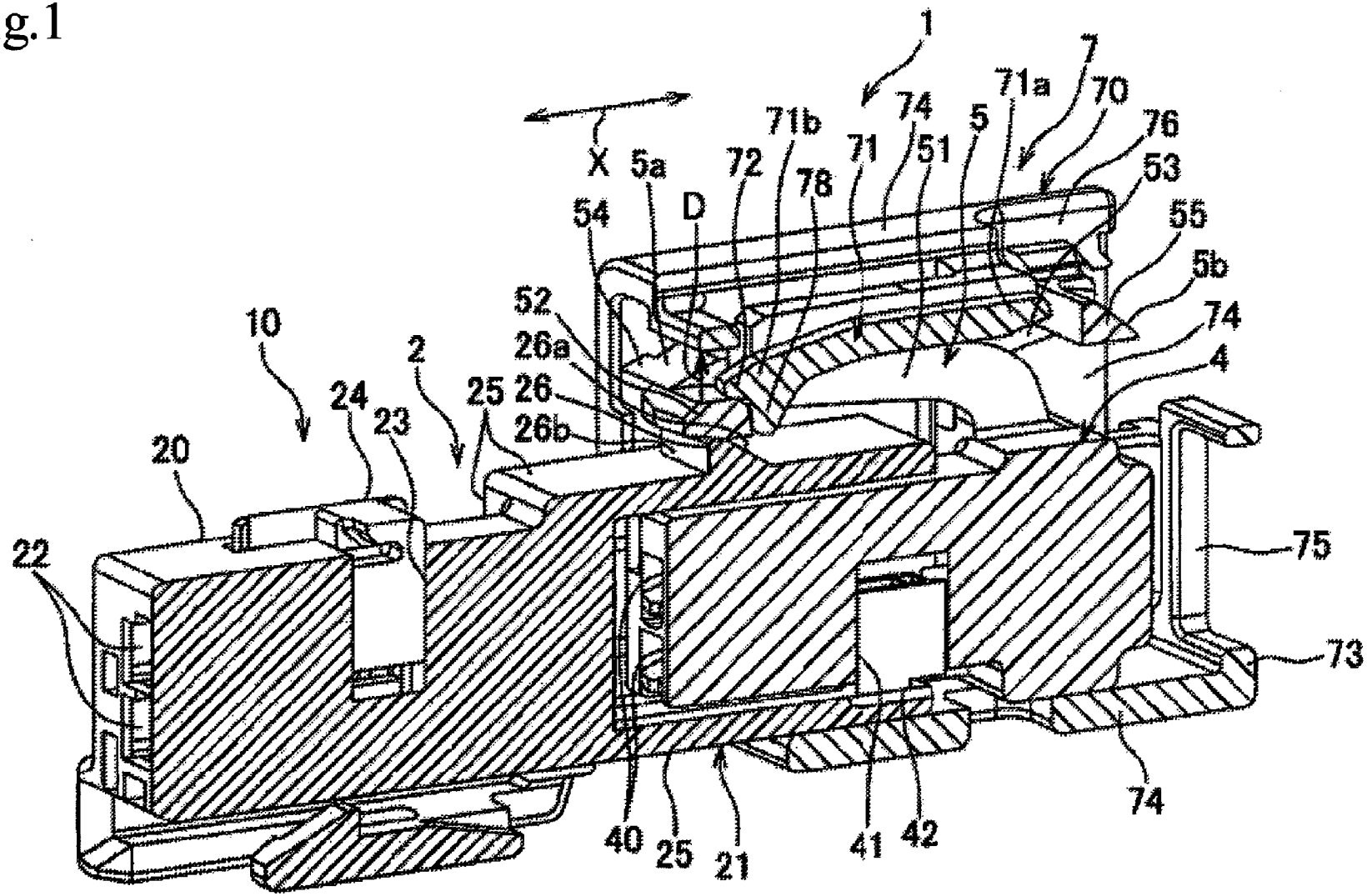
FIG. 1 is a perspective, cross-sectional view showing one exemplary embodiment of a lock ensuring mechanism-equipped connector of the present invention and a mating connector.

The spacer receiving chamber 23 is formed in a longitudinally-central portion of the housing body 20. The spacer receiving chamber 23 is formed in an upper surface (in FIG. 2) (which is one of outer surfaces of the housing body 20) of the housing body 20, and is in the form of a recess extending in a direction perpendicular to the fitting direction X. The spacer receiving chamber 23 also extends across the terminal receiving chambers 22. A spacer 24 for retaining the male terminals 3 received in the respective terminal receiving chambers 22 is inserted and received in the spacer receiving chamber 23. The spacer 24 shown in FIG. 1 is disposed in a condition immediately before it is completely received in the spacer receiving chamber 23.

The hood portion 21 includes a plurality of peripheral walls 25 extending toward the connector 1 from that end face of the housing body 20 close to the connector 1, and is formed into a square tubular shape. The male housing 4 is inserted into the hood portion 21 through an open end of the hood portion 21 remote from the housing body 20. A lock projection 26 serving as an engagement portion is formed on the upper peripheral wall 25 (in FIG. 2) which is one of the plurality of peripheral walls 25 of the hood portion 21. The lock projection 26 projects from an outer surface of the upper peripheral wall 25.

The lock projection 26 has a tapering surface 26*a* and a vertical surface 26*b*. The tapering surface 26*a* is formed on that side of the lock projection 26 facing the connector 1, and is slanting relative to the fitting direction X such that the distance between the tapering surface 26*a* and the upper peripheral wall 25 is gradually decreasing toward the connector 1. The vertical surface 26*b* is formed on that side of the lock projection 26 remote from (or facing away from) the connector 1, and is flat along a direction perpendicular to the fitting direction X.

The male terminal 3 is formed by blanking a metal piece from an electrically-conductive metal sheet and then by bending the metal piece into a predetermined shape. As shown in FIG. 2 and others, the male terminal 3 of a one-piece construction includes a wire connection portion 31, a tubular portion 32, and a tab 33 serving as an electrical contact portion. In the male terminal 3, the wire connection portion 31, the tubular portion 32 and the tab 33 are arranged in a row in this order.

The wire connection portion 31 includes a strip-like bottom plate portion 34, and press-fastening piece portions 35 extending from opposite side edges of the bottom plate portion 34. An end portion of a wire (not shown) having an exposed portion of a conductor is placed on the bottom plate portion 34, and then the press-fastening piece portions 35 are crimped or press-fastened onto the end portion of the wire, and by doing so, the wire is secured to the wire connection portion 31, so that the wire connection portion 31 is electrically and mechanically connected to the conductor of the wire.

The tubular portion 32 is continuous with both the wire connection portion 31 and the electrical contact portion 33, and is formed into a square tubular shape. An outer surface of the tubular portion 32 is disposed in intimate contact with the inner surface of the terminal receiving chamber 22. The tubular portion 32 is retainingly engaged with the retaining arm 22*a*, thereby preventing the male terminal 3 from being withdrawn from the terminal receiving chamber 22.

The tab 33 extends from the tubular portion 32, and has a strip-like shape. A distal end portion of the tab 33 remote from the tubular portion 32 is tapering toward its distal end. The tab 33 is inserted into an electrical contact portion 62 of the female terminal 6 (described later) of the connector 1, and is retained therein, and therefore is electrically and mechanically connected to the female terminal 6.

The male terminal 3 is mounted in the female housing 2 in such a manner that the electrical contact portion 31 and the tubular portion 32 are received in the terminal receiving chamber while the tab 33 projects into the interior of the hood portion 21. In FIG. 1, the showing of the male terminals 3 is omitted.

As shown in FIG. 2 and others, the connector 1 comprises the male-type connector housing (hereinafter referred to as "male housing") 4, a lock arm 5, the female-type metal terminals (hereinafter referred to as "female terminals") 6, and a lock ensuring member 7.

The male housing 4 is made of an insulative synthetic resin or the like. The male housing 4 is formed into a generally box-shape, and receives the female terminals 6 therein. As shown in FIG. 2 and others, the male housing 4 includes terminal receiving chambers 40, a spacer receiving chamber 41, and guide projections (not shown). In the present specification, the connector housing which is inserted into the tubular female housing 2 is called "the male housing 4".

The plurality of terminal receiving chambers 40 are arranged in parallel juxtaposed relation. Each terminal receiving chamber 40 extends straight, and longitudinally-opposite ends of the terminal receiving chamber 40 are open respectively to outer surfaces of the male housing 4. The terminal receiving chambers 40 receive the female terminals 6, respectively. A retaining arm 40*a* for retaining the female terminal 6 is formed on an inner surface of each terminal receiving chamber 40. The male housing 4 is inserted into the hood portion 21 along the fitting direction X so that the terminal receiving chambers 40 are continuous respectively with the terminal receiving chambers 22 of the female housing 2.

The spacer receiving chamber 41 is formed in a longitudinally-central portion of the male housing 4. The spacer receiving chamber 41 is formed in an lower surface (in FIG. 2) (which is one of outer surfaces of the male housing 4) of the housing body 20, and is in the form of a recess extending in a direction perpendicular to the fitting direction X. The spacer receiving chamber 41 also extends across the terminal receiving chambers 40. A spacer 42 for retaining the female terminals 6 received in the respective terminal receiving chambers 40 is inserted and received in the spacer receiving chamber 41. The guide projections project respectively from the pair of opposite side (outer) surfaces (in FIG. 2) of the male housing 4 perpendicularly intersecting the one outer surface (lower surface) thereof in which the spacer receiving chamber 41 is formed. The guide projections are adapted to be received respectively in guide grooves (described later) of the lock ensuring member 7.

The lock arm 5 is formed integrally on the outer surface (upper surface in FIG. 2) of the male housing 4 facing away from the one outer surface (lower surface) in which the spacer receiving chamber 41 is formed. The lock arm 5 includes a pair of support arms 51, a lock beak 52, a pair of cancellation arms 53, fulcrum projections 54 (FIG. 1), and an operating portion 55.

Each support arm 51 is formed into a generally bar-shape, and extends longitudinally along the longitudinal direction of the terminal receiving chambers 40, that is, along the fitting direction X. The pair of support arms 51 are disposed in parallel spaced relation to each other. The support arms 51 are integrally formed at one (longitudinal) ends thereof on that end portion of the male housing 4 remote from the mating connector 10, and the other ends thereof close the mating connector 10 are free.

Figure 5:
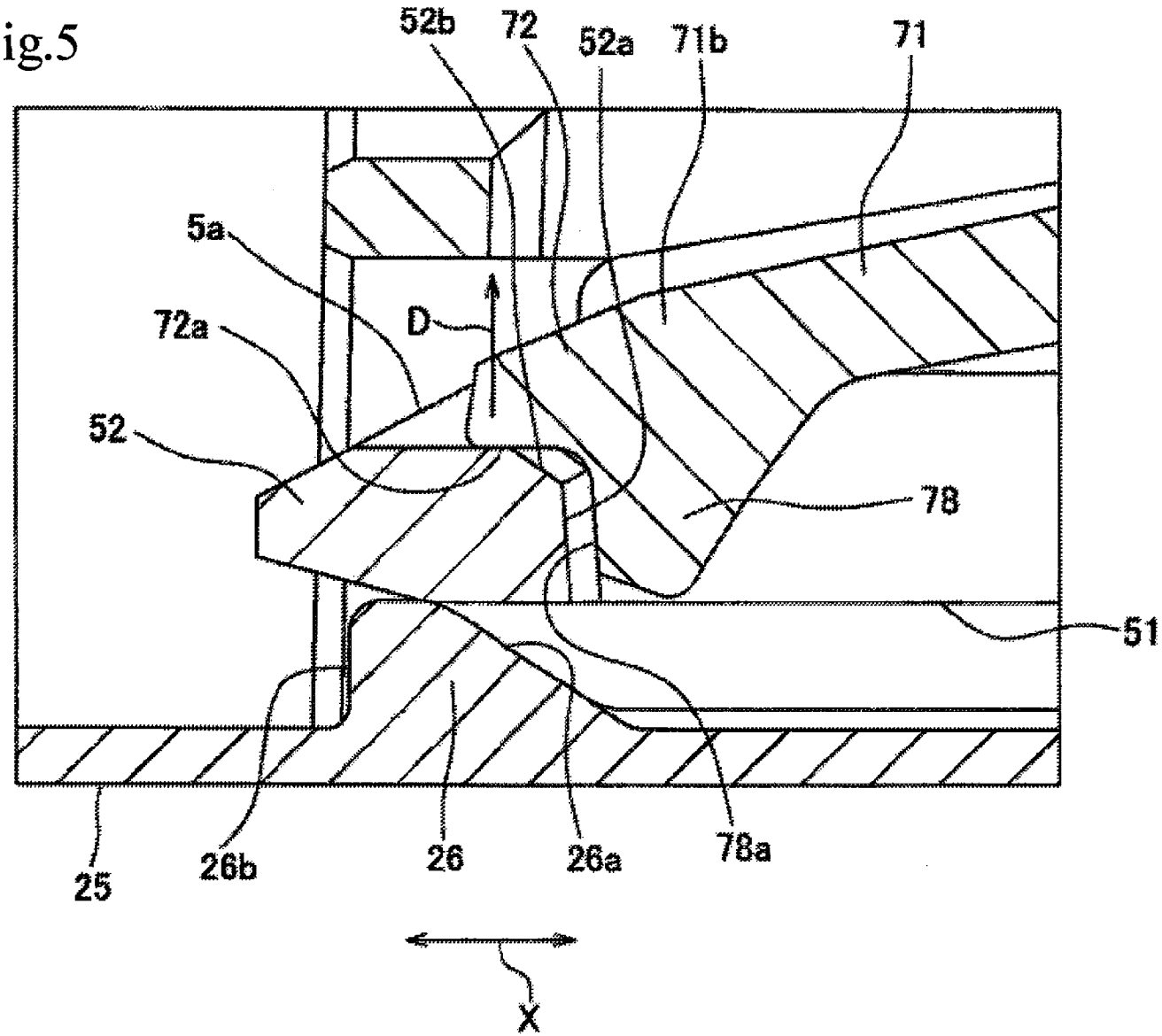
FIG. 5 is a cross-sectional view showing a portion A of FIG. 4 on an enlarged scale.

The lock beak 52 interconnects the other ends of the pair of support arms 51. The lock beak 52 has a generally-vertical surface 52*a* and a tapering surface 52*b* (FIG. 5). The vertical surface 52*a* is formed on that side of the lock beak 52 remote from (or facing away from) the mating connector 10, and when the lock arm 5 is engaged with the lock projection 26, this vertical surface 52*a* is disposed in contiguous relation to the vertical surface 26*b* of the lock projection 26. The vertical surface 52*a* is flat along a direction generally perpendicular to the fitting direction X. The tapering surface 52*b* is formed on the side of the lock beak 52 remote from (or facing away from) the mating connector 10, and when the lock arm 5 is engaged with the lock projection 26, this tapering surface 52*b* is disposed remoter from the male housing 4 than the apex portion of the lock projection 26. The tapering surface 52*b* is slanting relative to the fitting direction X such that the distance between the tapering surface 52*b* and the male housing 4 is gradually increasing toward the mating connector 10.

Each of the pair of cancellation arms 53 is formed into a generally bar-shape, and extends longitudinally along the longitudinal direction of the terminal receiving chambers 40, that is, along the fitting direction X. The pair of cancellation arms 53 are arranged parallel to the pair of support arms 51, and are disposed respectively at the outer sides of the pair of support arms 51. The pair of cancellation arms 53 are disposed in parallel spaced relation to each other. The pair of cancellation arms 53 are integrally formed at one (longitudinal) ends thereof with the other ends of the support arms 51, respectively, and the other ends thereof remote from the mating connector 10 are free.

The fulcrum projections 54 are formed on and project respectively from the one ends of the pair of cancellation arms 53 away from each other in the direction of spacing of the pair of cancellation arms 53 from each other. The operating portion 55 interconnects the other ends of the cancellation arms 53.

Figure 3:
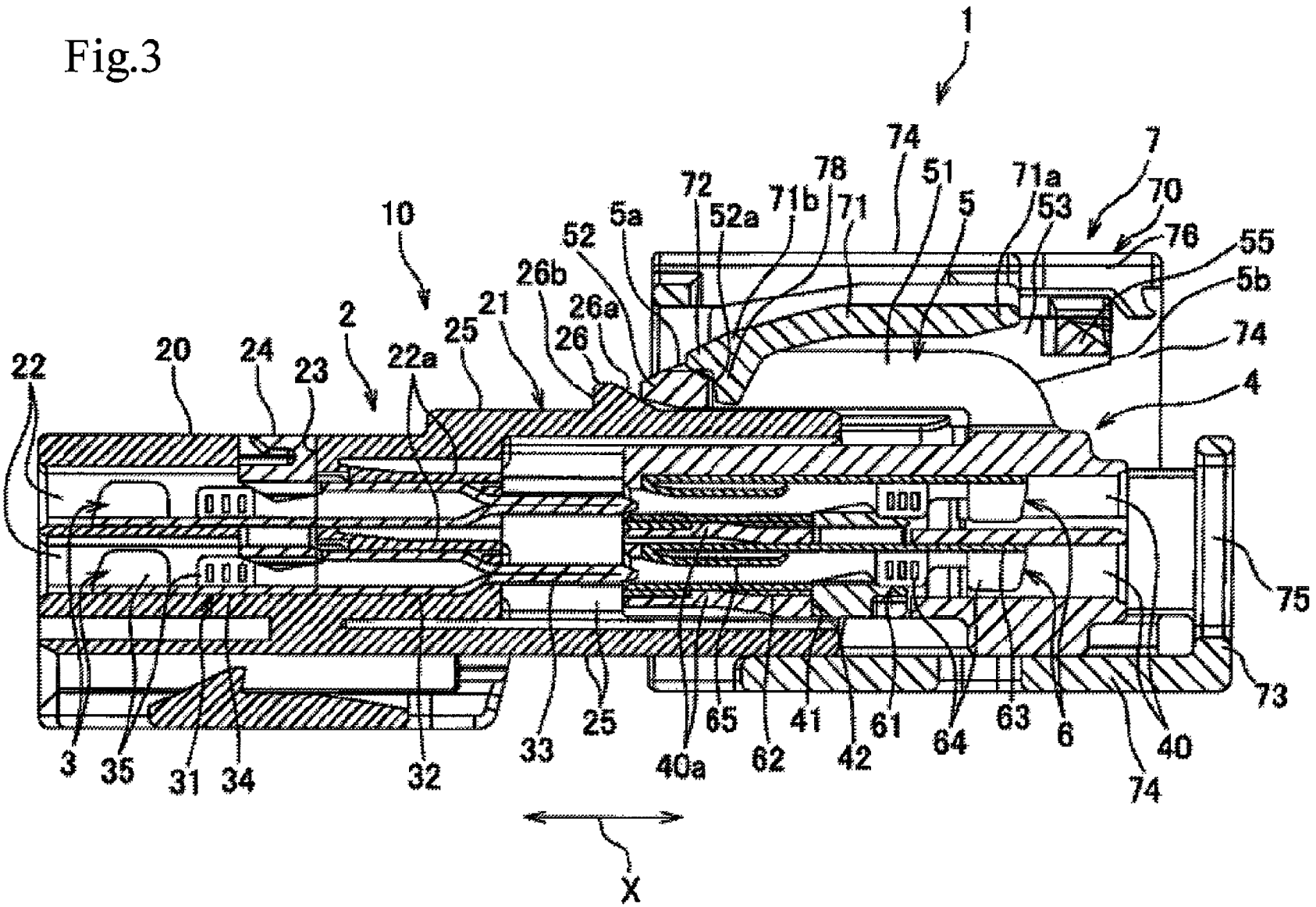
FIG. 3 is a cross-sectional view showing a condition in which the connectors of FIG. 2 are moved toward each other, so that a lock arm and a lock projection abut against each other.
Figure 6:
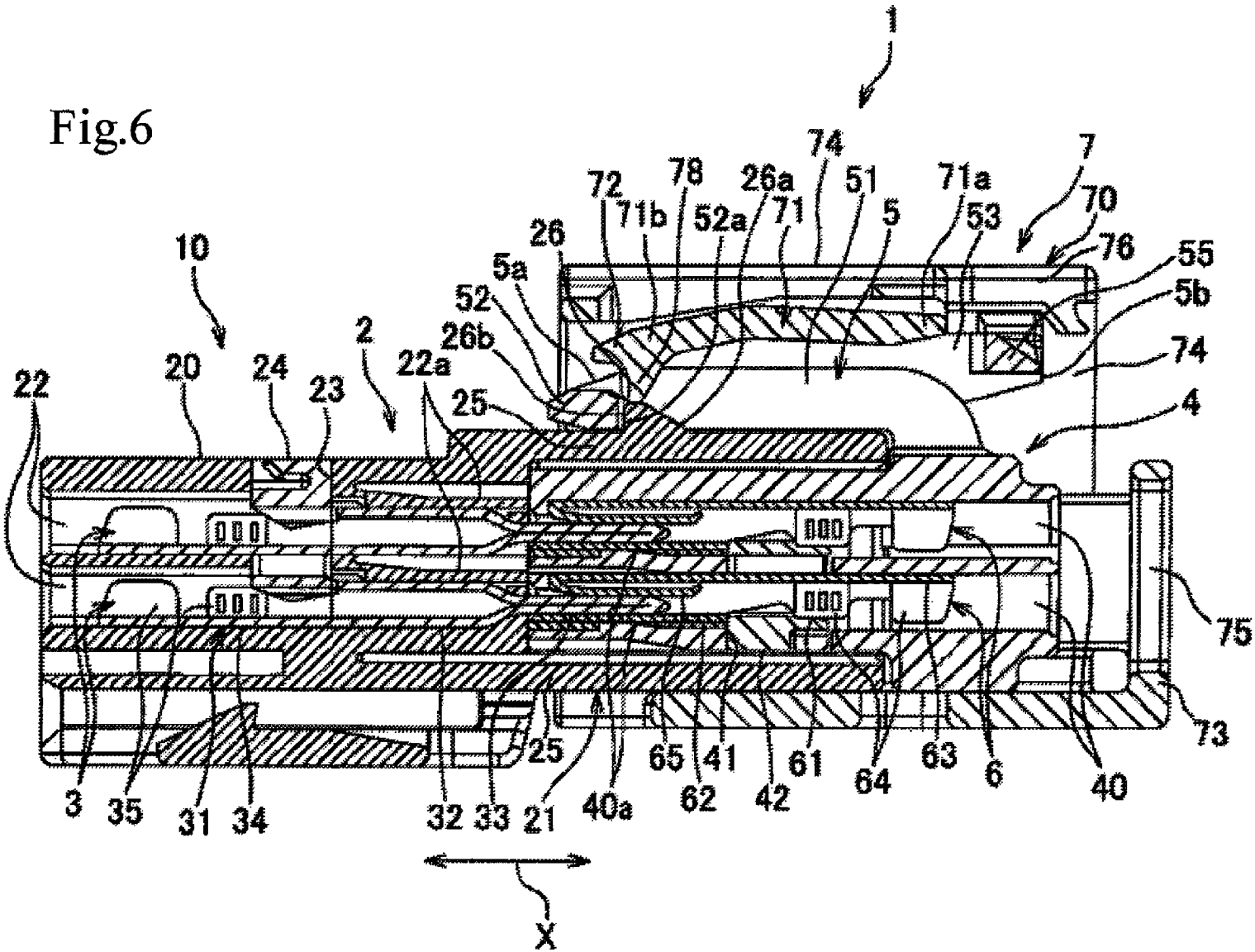
FIG. 6 is a cross-sectional view showing a condition in which the connectors of FIG. 4 are completely fitted together, and the lock arm and the lock projection are completely engaged with each other.
Figure 7:
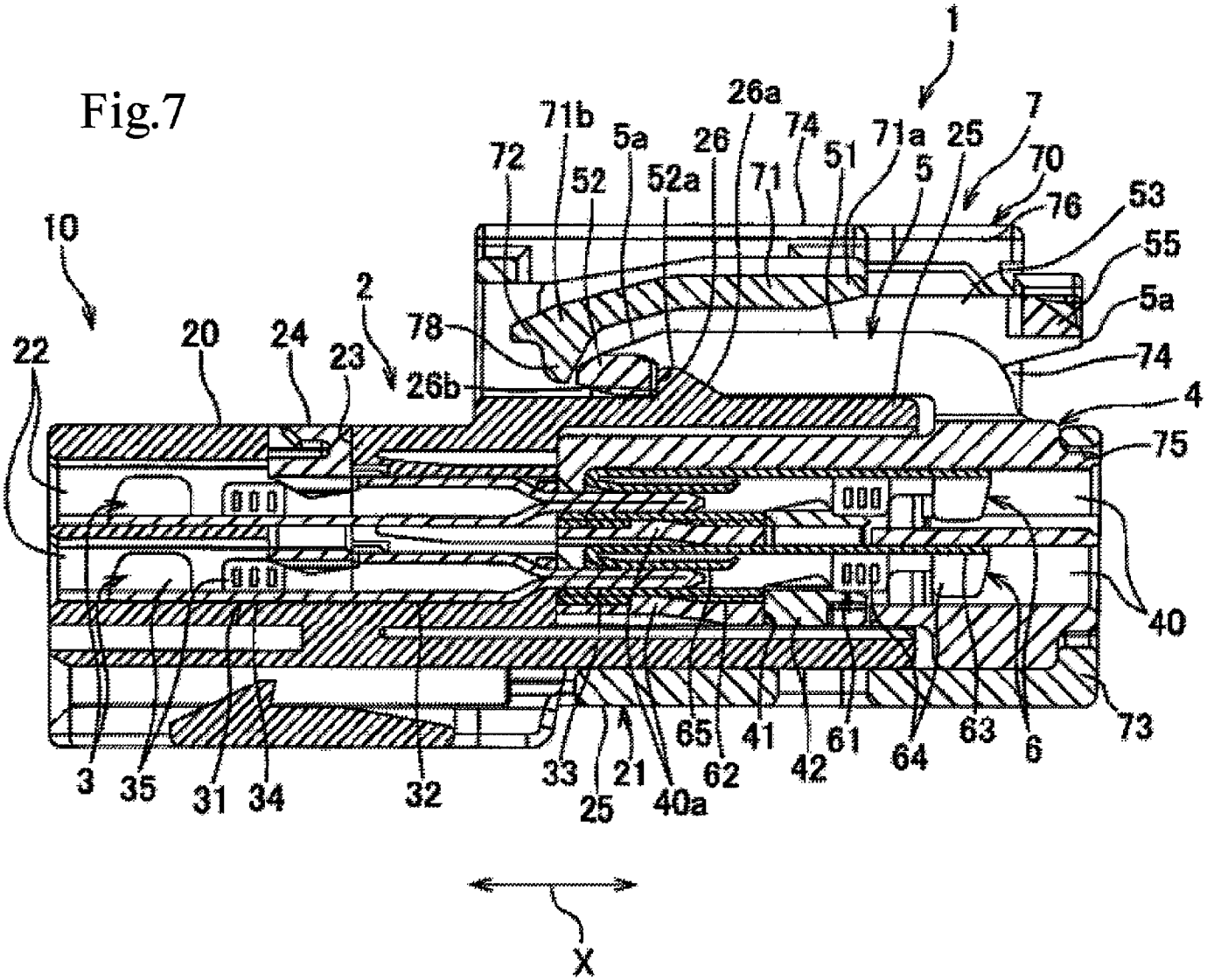
FIG. 7 is a cross-sectional view showing a condition in which a lock ensuring member shown in FIG. 6 is located in a preventing position.
Figure 8:
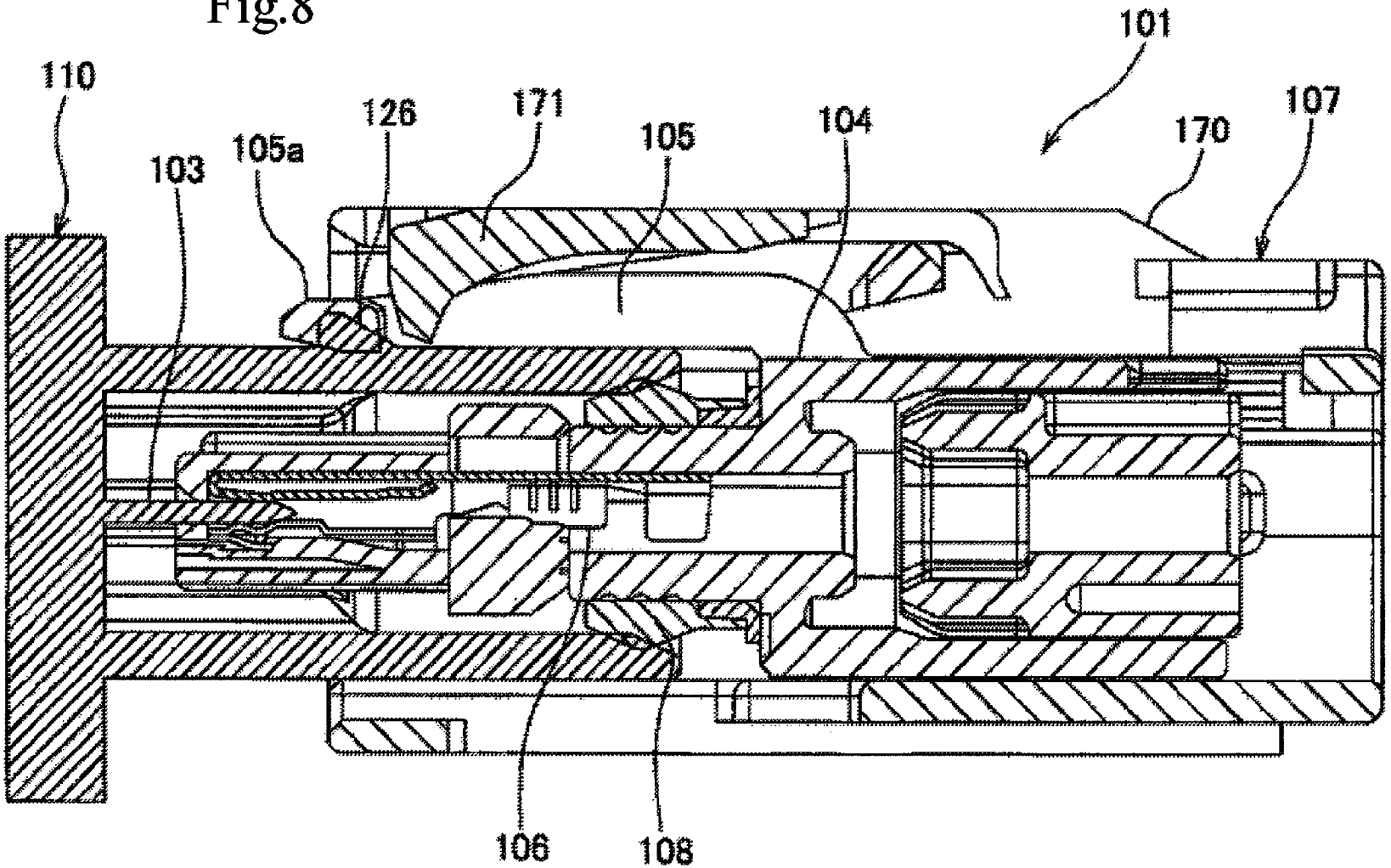
FIG. 8 is a cross-sectional view showing a conventional lock ensuring mechanism-equipped connector.

As shown in FIGS. 6 and 7, one end portion 5*a* of the lock arm 5 close to the mating connector 10 is engaged with the lock projection 26 located in a space defined by the pair of support arms 51 and the lock beak 52. When the lock arm 5 is to be engaged with the lock projection 26, the lock beak 52 abuts against the lock projection 26 as shown in FIG. 3. Then, the lock beak 52 of the lock arm 5 slides onto the lock projection 26 as shown in FIG. 4, and the lock arm 5 is elastically deformed in such a manner that the one end portion 5*a* thereof is moved outwardly away from the male housing 4.

Figure 4:
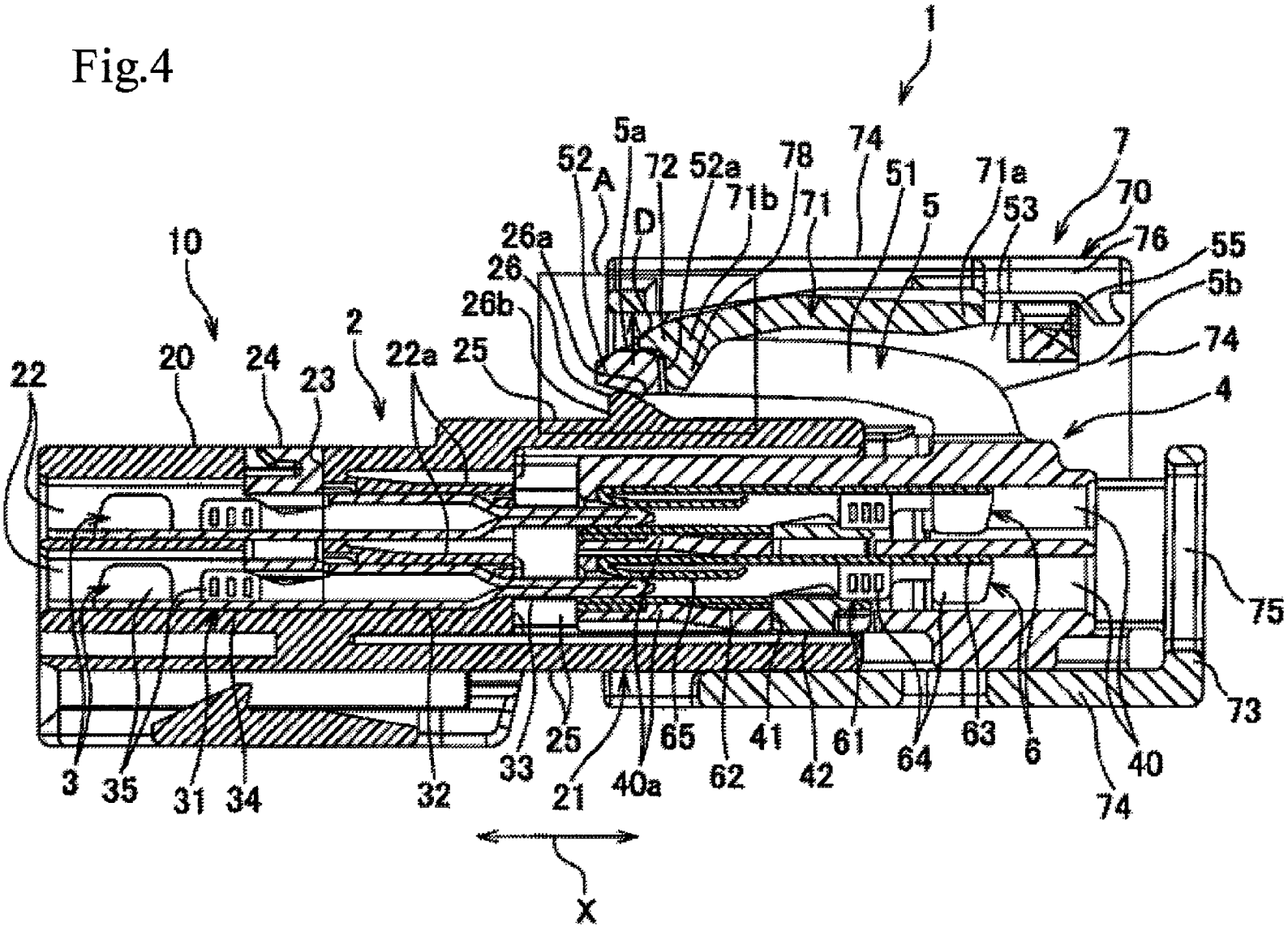
FIG. 4 is a cross-sectional view showing a condition in which the connectors of FIG. 3 are further moved toward each, so that the lock arm slides onto the lock projection.

The direction of elastic deformation of the lock arm 5 is indicated by arrow D (FIGS. 1, 4 and 5). When the lock beak 52 slides over (or past) the lock projection 26, the lock arm 5 is restored into its neutral condition (non-elastically-deformed condition) because of its own elastic restoring force, and as a result the one end portion 5*a* of the lock arm 5 is engaged with the lock projection 26, with the lock projection 26 received in the space defined by the pair of support arms 51 and the lock beak 52.

When the operating portion 55 formed at the other end portion 5*b* of the lock arm 5 remote from the mating connector 10 is pressed toward the male housing 4, the lock arm 5 is elastically deformed in such a manner that the one end portion 5*a* thereof is moved in the elastically-deforming direction D. When the operating portion 55 is thus pressed toward the male housing 4, the lock arm 5 can be elastically deformed so that the engagement of the one end portion 5*a* with the lock projection 26 can be canceled. Incidentally, when the lock ensuring member 7 is located in a preventing position (described later), the fulcrum projections 54 abut against an inner surface of the lock ensuring member 7 to prevent the lock arm 5 from being elastically deformed, thereby preventing the engagement of the one end portion 5*a* with the lock projection 26 from being canceled.

The female terminal 6 is formed by blanking a metal piece from an electrically-conductive metal sheet and then by bending the metal piece into a predetermined shape. As shown in FIG. 2 and others, the female terminal 6 of a one-piece construction includes a wire connection portion 61, and the electrical contact portion 62.

The wire connection portion 61 includes a strip-like bottom plate portion 63, and press-fastening piece portions 64 extending from opposite side edges of the bottom plate portion 63. An end portion of a wire (not shown) having an exposed portion of a conductor is placed on the bottom plate portion 63, and then the press-fastening piece portions 64 are crimped or press-fastened onto the end portion of the wire, and by doing so, the wire is secured to the wire connection portion 61, so that the wire connection portion 61 is electrically and mechanically connected to the conductor of the wire.

The electrical contact portion 62 is continuous with the wire connection portion 61, and is formed into a square tubular shape. The tab 33 of the male terminal 3 is inserted into the electrical contact portion 62. A resilient contact piece 65 for holding the tab 33 of the male terminal 3 between it and a lower inner surface (in FIG. 2) of the electrical contact portion 62 is provided within the electrical contact portion 62. The tab 33 is held between the lower inner surface of the electrical contact portion 62 and the resilient contact piece 65, so that the electrical contact portion 62 is electrically and mechanically connected to the male terminal 3.

The female terminals 6 are mounted in the male housing 4, and are received respectively in the terminal receiving chambers 40 of the male housing 4 in such a manner that the electrical contact portion 62 are opposed to the mating connector 10.

The lock ensuring member 7 is made of an insulative synthetic resin or the like. As shown in FIG. 2 and others, the lock ensuring member 7 includes a body 70, an elastic arm serving as an interference arm 71, and a pressing projection (projecting) 72.

The body 70 has a generally square tubular shape with a closed bottom, and includes one rear end wall 73, and a plurality of peripheral walls 74 extending perpendicularly from an outer peripheral edge of the end wall 73. A passage hole 75 for the passage of the wires (secured respectively to the female terminals 6) therethrough is formed through the end wall 73. An operating hole 76 is formed at the upper peripheral wall 74 (in FIG. 2) (which is one of the plurality of peripheral walls 74) and the end wall 73. More specifically, the operating hole 76 is formed through both the upper peripheral wall 74 and the end wall 73.

The pair of guide grooves for respectively receiving the above-mentioned guide projections are formed respectively in inner surfaces of the pair of (opposite side) peripheral walls 74 perpendicularly intersecting the upper peripheral wall 74 having the operating hole 76. The guide grooves extend along the fitting direction X. The guide projections of the male housing 4 are received respectively in the guide grooves, and as a result the body 70 is mounted on the male housing 4 so as to move relative to the male housing 4.

The interference arm 71 has a strip-like shape, and extends longitudinally along the fitting direction X. The interference arm 71 is formed integrally with the body 70, and is disposed within the body 70. One (longitudinal) end portion 71*a* of the interference arm 71 is formed integrally with that end portion of the upper peripheral wall 74 disposed close to the end wall 73, and therefore is formed integrally with the body 70. The other end portion 71*b* of the interference arm 70 is disposed closer to the mating connector 10 than the one end portion 71*a* thereof, and is formed as a free end portion. The interference arm 71 can be elastically deformed in such a manner that the other end portion 71*b* is moved apart from the male connector 4. An interference projection 78 serving as an interference portion is formed at the other end portion 71*b* of the interference arm 71.

The interference projection 78 is formed at the other end portion 71*b* of the interference arm 71, and projects from the other end portion 71*b* toward the inside of the lock ensuring member 7. When the lock ensuring member 7 is mounted on the male housing 4, and is located in an allowing position (described later), the interference projection 78 is located in the space defined by the pair of support arms 51 and the lock beak 52, and is opposed to the lock beak 52 and hence the one end portion 5*a* of the lock arm 5 in the fitting direction X. An outer surface of the interference projection 78 to be opposed to the lock beak 52 serves as an interference surface 78*a* (FIG. 5). The interference surface 78*a* is flat along a direction generally perpendicular to the fitting direction X.

The pressing projection 72 is formed at the other end portion 71*b* of the interference arm 71, and projects from the other end portion 71*b* toward the mating connector 10. When the lock ensuring member 7 is mounted on the male housing 4, and is located in the allowing position (described later), the pressing projection 72 is disposed above the lock beak 52 (in FIG. 2) and is opposed to the lock beak 52 in the elastically-deforming direction D.

When the lock arm 5 is elastically deformed immediately before the lock arm 5 and the lock projection 26 are completely engaged with each other, the pressing projection 72 is superposed on the lock beak 52 (that is, on the one end portion 5*a* of the lock arm 5) in the elastically-deforming direction D. When the lock arm 5 is completely engaged with the lock projection 26 and is restored into the neutral condition, the pressing projection 72 is not superposed on the lock beak 52 (that is, on the one end portion 5*a* of the lock arm 5). The outer surface of the pressing projection 72 which is superposed on (or opposed to) the lock beak 52 serves as a pressing surface 72*a* (FIG. 5). This pressing surface 72*a* is generally flat along the fitting direction X.

The lock ensuring member 7 is mounted on the male housing 4 such that the male housing 4 is received in the body 70, with the end wall 73 opposed to a rear end face (in FIG. 2) of the male housing 4 remote from the mating connector 10. Also, the lock ensuring member 7 is mounted on the male housing 4 such that the operating portion 55 of the lock arm 5 is exposed through the operating hole 76 and that the pressing projection 72 and the interference projection 78 are opposed to the lock beak 52 of the lock arm 5.

Furthermore, the lock ensuring member 7 is mounted on the male housing 5 such that the guide projections of the male housing 4 are received respectively in the guide grooves of the body 70 so that the lock ensuring member 7 can move relative to the male housing 4 along the fitting direction X. The lock ensuring member 7 is mounted on the male housing 4 so as to move along the fitting direction between the allowing position (FIGS. 1 to 6) where the end wall 73 is spaced apart from the rear end face of the male housing 4 and the preventing position (FIG. 7) (which is closer to the mating connector 10 than the allowing position) where the end wall 73 is held against the rear end face of the male housing 4.

Further, restricting projections (not shown) which prevent the lock ensuring member 7 from moving relative to the male housing 4 beyond the preventing position and the allowing position are formed on the inner surface of the lock ensuring member 7 and the outer surface of the male housing 4. Also, projections and others (not shown) which give a click feeling during the movement of the lock ensuring member 7 between the preventing position and the allowing position are formed on the inner surface of the lock ensuring member 7 and the outer surface of the male housing 4. To give such a click feeling means that the lock ensuring member 7 located in the preventing position is held in this preventing position, that the lock ensuring member 7 located in the allowing position is held in this allowing position and that a resistance, etc., are applied to the lock ensuring member 7 when the lock ensuring member 7 is moved between the preventing position and the allowing position.

In the allowing position, the interference projection 78 of the interference arm 71 is located remoter from the mating connector 10 than the lock beak 52, and is located in the space defined by the pair of support arms 51 and the lock beak 52, as shown in FIGS. 1 to 6. Therefore, in the allowing position, the interference projection 78 of the interference arm 71 does not interferes with the lock beak 52, and allows the lock arm 5 to be elastically deformed in the elastically-deforming direction D. Thus, in the allowing position, the interference arm 71 allows the lock arm 5 to be elastically deformed, and hence allows the lock arm 5 to be engaged with the lock projection 26, and also allows this engagement to be canceled.

In the preventing position, the interference projection 78 of the interference arm 71 is located closer to the mating connector 10 than the lock beak 52 of the lock arm 5 as shown in FIG. 7. Therefore, in the preventing position, the interference projection 78 of the interference arm 71 interferes with the lock beak 52, thereby preventing the lock arm 5 from being elastically deformed in the elastically-deforming direction D. Thus, in the preventing position, the interference arm 71 prevents the lock arm 5 from being elastically deformed, and hence prevents the lock arm 5 from being engaged with the lock projection 26, and also prevents this engagement from being canceled.

In the allowing position, before the lock projection 26 is located in the space defined by the pair of support arms 51 and the lock beak 25 (that is, before the lock arm 5 is completely engaged with the lock projection 26) as shown in FIGS. 1 to 5, the interference surface 78*a* of the interference projection 78 of the interference arm 71 and the vertical surface 52*a* of the lock beak 52 are opposed to each other in the fitting direction X. Therefore, the interference projection 78 of the interference arm 71 interferes with the lock beak 52, that is, with the one end portion 5*a* of the lock arm 5, to prevent the lock ensuring member 7 from being moved relative to the male housing 4 from the allowing position toward the preventing position. Thus, before the lock arm 5 and the lock projection 26 are completely engaged with each other, the interference arm 71 interferes with the one end portion 5*a* of the lock arm 5 to prevent the lock ensuring member 7 from being moved relative to the male housing 4 from the allowing position toward the preventing position.

In the allowing position, when the lock beak 52 slides onto the lock projection 26 as a result of elastic deformation of the lock arm 5 shown in FIGS. 1, 4 and 5, and is held in this condition, the engagement of the lock arm 5 with the lock projection 26 is incomplete (a half-engaged condition), and also the fitting of the connector 1 and the mating connector 10 to each other is incomplete (a half-fitted condition). This condition will hereinafter be referred to as "half-fitted condition". FIGS. 1 and 4 are a perspective, cross-sectional view and a cross-sectional view, respectively, through different cross-sectional planes, but showing the same positional relation between the connector 1 and the mating connector 10.

In this half-fitted condition, the pressing projection 72 is superposed on the lock beak 52, that is, on the one end portion 5*a* of the lock arm 5, in the elastically-deforming direction D. Therefore, the pressing surface 72*a* of the pressing projection 72 is pressed by the lock beak 52 of the elastically-deformed lock arm 5, and the pressing projection 72 is pushed upward, so that the interference arm 71 is elastically deformed in such a manner that the other end portion 71*b* thereof is moved toward the outside of the lock ensuring member 7. Thereafter, because of the elastic restoring force of the interference arm 71, the pressing surface 72*a* of the pressing projection 72 presses the lock beak 52 of the elastically-deformed lock arm 5 so as to restore the lock arm 5 into the neutral condition.

Thus, in the half-fitted condition, the force for restoring the lock arm 5 into the neutral condition so as to push the lock projection 26 back (that is, the force for moving or separating the connectors 1 and 10 away from each other in the fitting direction X) is produced by both the elastic restoring force of the lock arm 5 and the elastic restoring force of the interference arm 71 which causes the pressing projection 72 to press the lock arm 5.

In other words, since the pressing projection 72 presses the lock arm 5 while the lock projection 26 deforms lock arm 5 at the allowing position, the elastic restoring force of the interference arm 71 works for moving or separating the connectors 1 and 10 away from each other in the fitting direction X.

The above separating force can be made larger than the force required form withdrawing the tabs 33 of the male terminals 3 from the electrical contact portions 62 of the respective female terminals 6, for example, by suitably determining the amount of projecting of the pressing projection 72, the disposition of the pressing projection 72 on the interference arm 71, the elastic restoring force of the interference arm 71 and the elastic restoring force of the lock arm 5. By doing so, when the fitting operation is interrupted, for example, by releasing the operator's hold of the connectors, the connectors 1 and 10 can be separated from each other while withdrawing the tabs 33 from the respective electrical contact portions 62. Furthermore, by suitably determining the dispositions of the interference arm 71, the pressing projection 72 and the lock arm 5, the connectors 1 and 10 can be moved away from each other to such an extent that the male terminals 3 do not contact (and hence are not electrically connected to) the female terminals 6, respectively.

In the allowing position, when the lock beak 52 of the lock arm 5 slides over the lock projection 26, so that the lock projection 26 is located in the space defined by the pair of support arms 51 and the lock beak 52 as shown in FIG. 6, the lock arm 5 and the lock projection 26 are completely engaged with each other (a completely-engaged condition), and also the connector 1 and the mating connector 10 are completely fitted together (a completely-fitted condition). This condition will hereinafter be referred to as "completely-fitted condition".

In this completely-fitted condition, the interference projection 78 of the interference arm 71 lies on the apex portion of the lock projection 26 and the tapering surface 52*b* of the lock beak 52, and the interference surface 78*a* of the interference projection 78 is offset from the vertical surface 52*a* of the lock beak 52 in a direction generally perpendicular to the fitting direction X. Therefore, the interference projection 78 of the interference arm 71 does not interfere with the lock beak 52, that is, with the one end portion 5*a* of the lock arm 5, thereby allowing the lock ensuring member 7 to be moved relative to the male housing 4 from the allowing position toward the preventing position. Thus, in the completely-fitted condition in which the lock arm 5 and the lock projection 26 are completely engaged with each other, the interference of the interference arm 71 with the one end portion 5*a* of the lock arm 5 is canceled by the lock projection 26, and the interference arm 71 allows the lock ensuring member 7 to be moved relative to the male housing 4 from the allowing position toward the preventing position.

When the connector 1 of the above construction is to be fitted to the mating connector 10, first, the lock ensuring member 7 is located in the allowing position, and the connector 1 and the mating connector 10 are opposed to each other in spaced relation to each other as shown in FIG. 2. Then, the mating connector 10 is moved toward the connector 1 in the fitting direction X, and the hood portion 21 is inserted into a space between the body 70 of the lock ensuring member 7 and the male housing 4, so that the male housing 4 is inserted into the hood portion 21. As a result, the tapering surface 26*a* of the lock projection 26 is brought into abutting engagement with the lock beak 52 as shown in FIG. 3.

When the connectors 1 and 10 are further moved toward each other, the lock beak 52 slides onto the tapering surface 26*a* of the lock projection 26, so that the lock arm 5 is elastically deformed, and also the distal end portions of the tabs 33 of the male terminals 3 are inserted respectively into the electrical contact portions 62 of the female terminals 6, and therefore the connectors 1 and 10 are disposed in the half-fitted condition as shown in FIGS. 1 and 4. At this time, the lock beak 52 of the elastically-deformed lock arm 5 is superposed on the pressing projection 72 in the elastically-deforming direction D, and pushes the pressing projection 72 upward to elastically deform the interference arm 71.

In this half-fitted condition, in addition to the elastic restoring force of the lock arm 5, the elastic restoring force of the interference arm 71 which causes the pressing projection 72 to press the lock arm 5 so as to restore the lock arm 5 into the neutral condition (that is, the pressing force of the pressing projection 72 due to the elastic restoring force of the interference arm 71) acts on the lock arm 5 so as to restore the lock arm 5 into the neutral condition. Therefore, when the fitting operation is interrupted in this half-fitted condition, the lock projection 26 is pushed back away from the lock beak 52, and also the lock arm 5 is restored into the neutral condition, and the connectors 1 and 10 are moved away from each other respectively to the positions shown in FIG. 3. At this time, the male terminals 3 whose distal end portions are inserted in the respective female terminals 6 are withdrawn from the respective female terminals 6, and are brought out of contact with the female terminals 6.

On the other hand, in the half-fitted condition, when the connectors 1 and 2 are further moved toward each other, the lock beak 52 slides over the lock projection 26, so that the lock arm 5 is restored into the neutral condition (non-elastically-deformed condition), and the lock projection 26 and the lock arm 5 are completely engaged with each other as shown in FIG. 6. At this time, the tabs 33 of the male terminals are inserted generally over their entire length in the electrical contact portions 62 of the respective female terminals 6, and are held therein, and therefore the male terminals 3 are electrically and mechanically connected to the respective female terminals 6. When the lock projection 26 and the lock arm 5 are completely engaged with each other, the interference arm 71 is elastically deformed such that the interference projection 78 lies on the apex portion of the lock projection 26 and the tapering surface 52*b* of the lock beak 52.

Thereafter, the lock ensuring member 7 is moved from the allowing position toward the preventing position. As a result, the interference projection 78 slides over the tapering surface 52*b* of the lock beak 52, and thus slides over both the lock projection 26 and the lock beak 52. Then, the interference arm 71 is restored into the neutral condition (non-elastically-deformed condition), and the lock ensuring member 7 is located in the preventing position as shown in FIG. 7. Thus, the connector 1 is completely fitted to the mating connector 10, and the lock ensuring member 7 is located in the preventing position.

In this embodiment, in the half-fitted condition before the lock projection 26 and the lock arm 5 are completely engaged with each other, the pressing projection 72 is pressed by the lock beak 52 of the elastically-deformed lock arm 5, that is, by the one end portion 5*a* of the lock arm 5, so that the interference arm 71 is elastically deformed, and then by the elastic restoring force of the interference arm 71, the pressing projection 72 presses the lock arm 5 so as to restore the lock arm 5 into the neutral condition. In addition to the elastic restoring force of the lock arm 5, the pressing force of the pressing projection 72 acts on the lock arm 5, and therefore the force for restoring the lock arm 5 into the neutral condition is increased, and the force for separating the half-fitted connectors 1 and 10 from each other is increased. Therefore, the connectors 1 and 2 disposed in the half-fitted condition can be easily separated from each other, and the half-fitting of the connectors 1 and 10 can be prevented.

The pressing projection 72 is formed at the other end portion 71*b* of the interference arm 71 which is the free end portion, and therefore because of the elastic restoring force of the interference arm 71, the pressing projection 72 can positively press the lock beak 52 and hence the one end portion 5*a* of the lock arm 5 with a larger force.

The interference projection 78 of the interference arm 71 prevents the movement of the lock ensuring member 7 and also allows this movement. Therefore, the pressing projection 72 can be formed on the interference arm 71 of a conventional construction, and the structure of the lock ensuring member 7 can be simplified. An elastically-deformable arm separate from the interference arm 71 may be additionally provided, and the pressing projection 72 may be formed on this arm, although the structure of the lock ensuring member 7 becomes complicated.

The above exemplary embodiment merely shows a typical form of the present invention, and the present invention is not limited to the above embodiment, and various modifications can be made without departing from the subject matter of the invention.

What is claimed is:

1. A connector comprising:

a first connector housing including a lock projection;

a second connector housing to be fitted to the first connector housing and integrally including a lock arm which is elastically deformed by the lock projection and is engaged with the lock projection;

a lock ensuring member including a body which is attached to the second connector housing and movable between an allowing position and a preventing position, and an interference arm which is integrally provided on the body and includes a pressing projection, wherein the pressing projection presses the lock arm while the lock projection deforms the lock arm at the allowing position, and the interference arm abuts the lock arm so as to prohibit the lock arm from deforming in the preventing position.

2. The connector according to claim 1, wherein the interference arm has a free end, the pressing projection is provided on the free end, and the pressing projection presses an end of the lock arm.

3. The connector according to claim 2, wherein the pressing projection superposes the end of the lock arm in a direction in which the lock arm deforms at the allowing position.

4. The connector according to claim 1, wherein the body is prohibited from moving until the lock arm is engaged with the lock projection and the body is movable while the lock projection is engaged with the lock projection.

5. The connector according to claim 3, wherein the interference arm includes a interference projection which interferes with the lock arm in a direction in which the body is movable until the lock projection is engaged with the lock arm so as to prevent the body from moving and not interferes the lock arm after the lock projection is engaged with the lock arm so as to make the body movable.

* * * * *